US005681155A

United States Patent [19]

Hisanaga et al.

[11] Patent Number: 5,681,155

[45] Date of Patent: Oct. 28, 1997

[54] SCROLL TYPE COMPRESSOR HAVING AN ELASTIC BODY IN THE DRIVEN CRANK MECHANISM

[75] Inventors: Shigeru Hisanaga, Kariya; Tsuyoshi Takemoto, Nukata-gun; Shigeki Iwanami; Haruhisa Shibata, both of Okazaki; Takeshi Sakai, Chiryu; Masafumi Nakashima, Anjo; Mikio Matsuda, Nishio; Tatsuhiko Fukanuma, Kariya; Tetsuo Yoshida, Kariya; Yasushi Watanabe, Kariya; Shinsuke Aso, Kariya, all of Japan

[73] Assignees: Nippondenso Co., Ltd.; Kabushiki Kaisha Toyoda Jidoshokki Seisakusho, both of Japan

[21] Appl. No.: 610,576

[22] Filed: Mar. 8, 1996

[30] Foreign Application Priority Data

Mar. 17, 1995 [JP] Japan ..... 7-059122
Oct. 16, 1995 [JP] Japan ..... 7-267377

[51] Int. Cl.[6] ..... F04C 18/04; F04C 29/00; F04C 29/02

[52] U.S. Cl. ..... 418/14; 418/55.5; 418/55.6; 418/57

[58] Field of Search ..... 418/14, 55.5, 55.6, 418/57

[56] References Cited

U.S. PATENT DOCUMENTS

| | | | |
|---|---|---|---|
| 4,314,796 | 2/1982 | Terauchi | 418/55.6 |
| 4,764,096 | 8/1988 | Sawai et al. | 418/57 |
| 5,076,772 | 12/1991 | Fraser, Jr. et al. | 418/55.6 |
| 5,328,342 | 7/1994 | Ishii et al. | 418/55.5 |
| 5,378,129 | 1/1995 | Dunaevsky et al. | 418/55.5 |

FOREIGN PATENT DOCUMENTS

| | | | |
|---|---|---|---|
| 0 643 224 A1 | 3/1995 | European Pat. Off. . | |
| 59-103979 | 6/1984 | Japan . | |
| 1-273890 | 11/1989 | Japan . | |
| 2-86976 | 3/1990 | Japan | 418/55.5 |
| 2-176179 | 7/1990 | Japan . | |
| 3-057893 | 3/1991 | Japan . | |
| 5-187366 | 7/1993 | Japan . | |

*Primary Examiner*—John J. Vrablik
*Attorney, Agent, or Firm*—Cushman, Darby & Cushman IP Group of Pillsbury Madison & Sutro LLP

[57] ABSTRACT

A scroll type compressor using a crank mechanism having enough freedom so that an amount of eccentricity of the movable scroll member becomes variable. An elastic body is inserted between the facing surfaces striking each other in the inside of the crank mechanism so as to prevent generation of a noise due to the collision of the parts when starting up or shutting down the compressor.

18 Claims, 7 Drawing Sheets

SCROLL TYPE COMPRESSOR HAVING AN ELASTIC BODY IN THE DRIVEN CRANK MECHANISM

BACKGROUND OF THE INVENTION

1. Field of the Invention

The present invention relates generally to a scroll type compressor preferably used as a refrigerant compressor in an air conditioning apparatus for an automobile for example and particularly relates to a scroll type compressor having an improved driven crank mechanism preventing noise generated when the compressor is started up or shut down (also referred to as ON/OFF time).

2. Description of the Related Art

In a conventional scroll type compressor, a fixed scroll member fixed and supported in a housing and having a spiral-shaped vane and a movable scroll member having a similar spiral-shaped vane for engaging with this are engaged with each other while shifted in phase in the direction of rotation on an eccentric axis so as to form a plurality of fluid compression pockets having crescent shapes when seen in an axial direction between the two spiral-shaped vanes. The movable scroll member is driven by rotation of a drive shaft via a crank mechanism and thereby performs an orbiting movement substantially not accompanied by rotation. As a result, the fluid compression pockets move from the outer periphery of the scroll member toward the center portion. The volume of the fluid compression pockets is reduced during this time. Therefore, the fluid fetched into the fluid compression pockets at the outer periphery is compressed and exhausted from the center portion.

As an improvement of such a scroll type compressor, a scroll type compressor having a so-called "driven crank mechanism" has been disclosed in Japanese Unexamined Patent Publication (Kokai) No. 2-176179 and Japanese Unexamined Patent Publication (Kokai) No. 5-187366. These driven crank mechanisms have slider portions, one of which is able to slidably move in a radial direction with respect to the other between the drive shaft side and the movable scroll member side driven by this, whereby the magnitude of the eccentricity of the movable scroll member with respect to the center of the fixed scroll member and the eccentricity of the drive shaft are changed and the state of contact in the contact portion forming a sealed portion of the fluid compression pocket between the spiral-shaped vanes of the fixed scroll member and the movable scroll member changes along with the change of the amount of eccentricity.

There are cases where this is done so as to simultaneously achieve the contradictory objects of sufficiently enhancing the sealing property by adjusting the sealing property of the contact portions of the two spiral-shaped vanes forming the fluid compression pockets in accordance with the magnitude of the anti-compression force acting upon the movable scroll member and, at the same time, preventing the occurrence of an excessive state of contact that causes wear on the surfaces of the vanes and cases where this is done for the purpose of reducing the eccentricity of the movable scroll member at the time when the compressor is shut down to intentionally form a gap at the contact portion between the two spiral-shaped vanes and thereby preventing occurrence of startup shock due to an abrupt increase of the load of the drive shaft when the scroll type compressor is next started up.

More specifically, one method for reducing the startup shock of a scroll type compressor is to use one and another member provided inside a driven crank mechanism connecting the drive shaft and the movable scroll member, for example a drive key in the substantially radial direction which is formed integrally with the drive shaft and a groove in the substantially radial direction formed in a bush supporting a cylindrical boss portion of the movable scroll member via a bearing, so as to constitute a slider portion and also to use a single elastic member to bias the slider portion such as providing a spring between one end surface of the drive key in the radial direction and the end surface of the groove of the bush corresponding to that end surface and use the biasing force of the same to form a gap at the contact portion between the vane of the fixed scroll member and the vane of the movable scroll member at the time of shutting down or starting up the operation of the compressor.

As mentioned before, a scroll type compressor having a driven crank mechanism has a variable amount of eccentricity of the movable scroll member, so when preventing startup shock by forming a gap at the contact portion between the spiral-shaped vanes at the time when the compressor is shut down, when the operation is restarted next, the anti-compression force of the fluid in the fluid compression pockets increases the amount of eccentricity of the movable scroll member and pushes the vane of the movable scroll member against the vane of the fixed scroll member, so that the gap between them is closed, but at this time, noise is generated since the spiral-shaped vane of the movable scroll member strikes the spiral-shaped vane of the fixed scroll member. Moreover, there exists a case where the drive key constituting part of the slider portion will strike the terminal end of the groove of the bush inside the driven crank mechanism and cause noise.

Such noise tends to become conversely stronger when improving the sliding property between the drive key and the groove of the slider portion by lubrication or another method. Also, in a hunting state where the contact between the spiral-shaped vanes occurs in a vibrating manner, the noise continues for as long as the hunting occurs. Further, not only at the time of the startup, but also at a time when the scroll type compressor is shut down, shock causing by the striking of for example the terminal end of the drive key constituting part of the slider portion of the driven crank mechanism and terminal end of the groove of the bush accepting this at the side away from the same during the operation is propagated to the spiral-shaped vane of the movable scroll member whereby noise is generated as well. Moreover, there also exists a case where noise is generated due to the collision of the vanes caused by the rotation accompanying abrupt changes of the orbiting radius.

SUMMARY OF THE INVENTION

In consideration of this problem in a conventional scroll type compressor having a driven crank mechanism, an object of the present invention is to provide an effective means having a simple configuration which can prevent the generation of noise at the contact portion between the spiral-shaped vanes in both of the cases of startup and shutdown of the scroll type compressor.

So as to achieve the object, the present invention provides a scroll type compressor as disclosed in the claims.

The scroll type compressor of the present invention performs the same fundamental operation as that of a conventional scroll type compressor, that is, fetches a fluid by fluid compression pockets formed between a spiral-shaped vane of a fixed scroll member and a spiral-shaped vane of a movable scroll member and compresses the fluid by continuous reduction of the volume of the fluid compression pockets.

A characteristic feature of the scroll type compressor of the present invention resides in the point of provision of at least one elastic member forming two compression regions between a drive projection and a groove so as to buffer collisions occurring between the two ends of the drive projection constituting part of a slider portion of a driven crank mechanism in the radial direction and the inner surfaces of the two ends of said groove facing the same, collisions between the spiral-shaped vanes of two scroll members, and collisions between the spiral-shaped vanes of the two scroll members which occur at the time of the startup of the scroll type compressor and thereby the prevention of the generation of noise due to the same.

When the scroll type compressor is started up, the drive projection or groove constituting part of the slider portion of the driven crank mechanism slides along the flat surface of the opposing groove or projection by the partial force of the increasing anti-compression force or the like and the terminal ends of the projection and groove collide or the spiral-shaped vane of the movable scroll member collides with the spiral-shaped vane of the fixed scroll member before or after this, thereby forming a sealing portion of the fluid compression pockets, but before this collision and the generation of noise due to this occur, one of the two compression regions caused by the elastic body attached between the drive projection and the groove is compressed, the collision is buffered by the repulsion force of the elastic body, and the occurrence of collisions and noise is prevented.

When the scroll type compressor shuts down its actual operation, the drive projection or groove in the driven crank mechanism slides along the flat surface of the opposing groove or projection due to the disappearance of the anti-compression force, the terminal ends of the projection and groove of the opposing side collide, or the spiral-shaped vane of the movable scroll member collides with the spiral-shaped vane of the fixed scroll member due to rotation, and noise is generated by the same, but in this case, the compression region opposite to that used at the time of the startup among the two compression regions created by the elastic body is compressed preceding the collision, so the shock is buffered by the repulsion force of the compression region of the elastic body and the occurrence of the collision and noise is prevented. In this way, according to the present invention, noise due to the collision of the sliding portion of the driven crank mechanism and the collision of the spiral-shaped vanes of the scroll members which are apt to occur at the time of the startup of the scroll type compressor can be prevented. The invention is not restricted to this. It is also possible to prevent noise due to collision at a portion opposite to that at the time of the activation of the sliding portion of the driven crank mechanism which is apt to occur at the time of the shut down of the actual operation. Accordingly, by addition of these effects with each other, it becomes possible to remarkably reduce the noise of the scroll type compressor.

Further, when a configuration making the position of the drive projection closer to the center of the drive shaft is adopted, it becomes easy to set a position at which the compression stress of the elastic body in two compression regions is balanced to a position where the orbiting radius becomes smaller. Due to this, a state where the orbiting radius is stably small at the time of a shutdown, that is a state where a gap exists between the spiral-shaped vanes of the two scroll members, is exhibited. As a result, it is possible to obtain also an effect that the compression work and startup torque become small at the time of the startup and the startup shock can be reduced.

BRIEF DESCRIPTION OF THE DRAWINGS

The present invention will be further concretely understood by the following explanation of preferred embodiments made by referring to the attached drawings; wherein.

DESCRIPTION OF THE PREFERRED EMBODIMENTS

Figure 1:
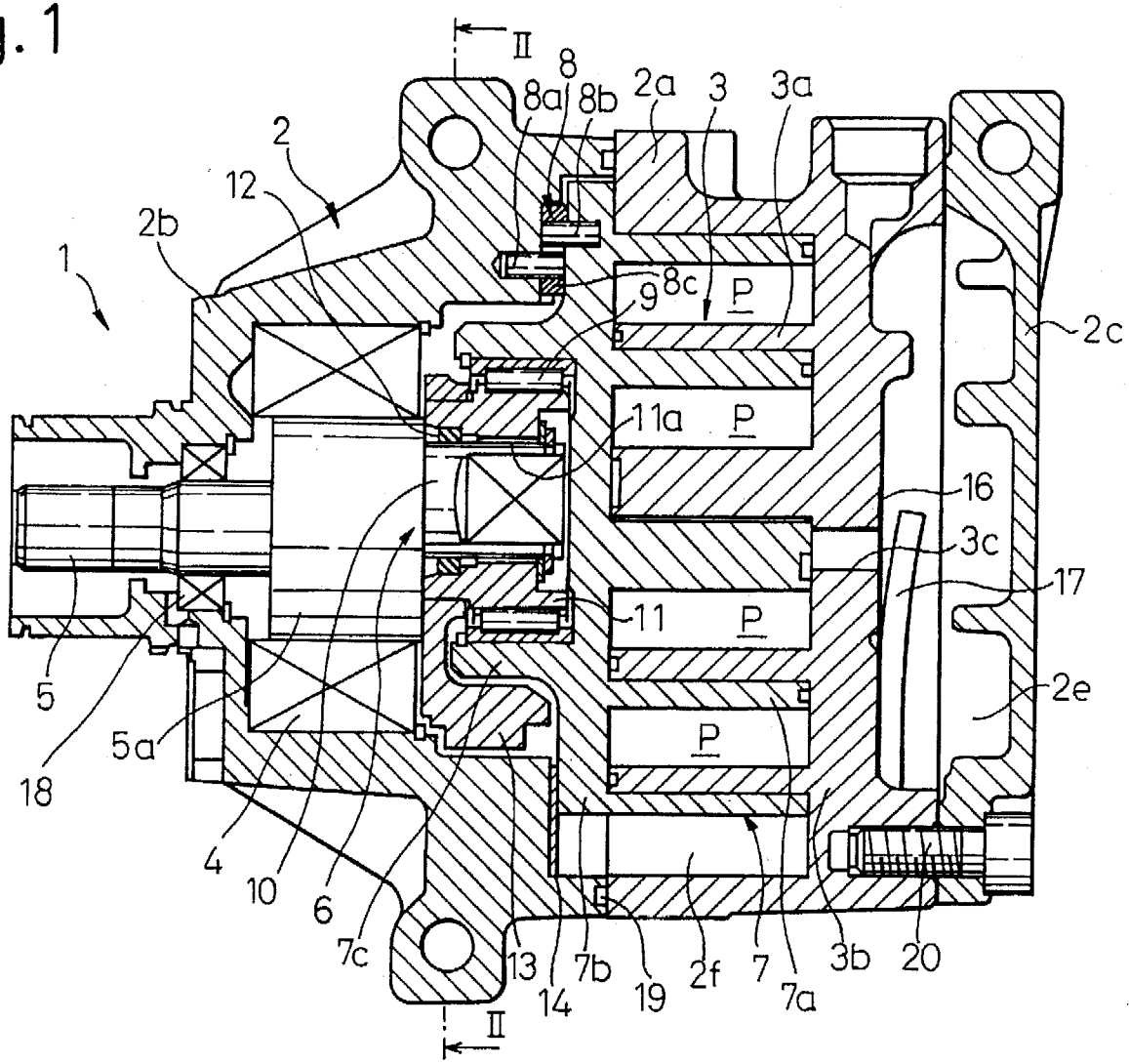
FIG. 1 is a longitudinal cross-sectional front view showing an overall configuration of a scroll type compressor according to an embodiment of the present invention.
Figure 2:
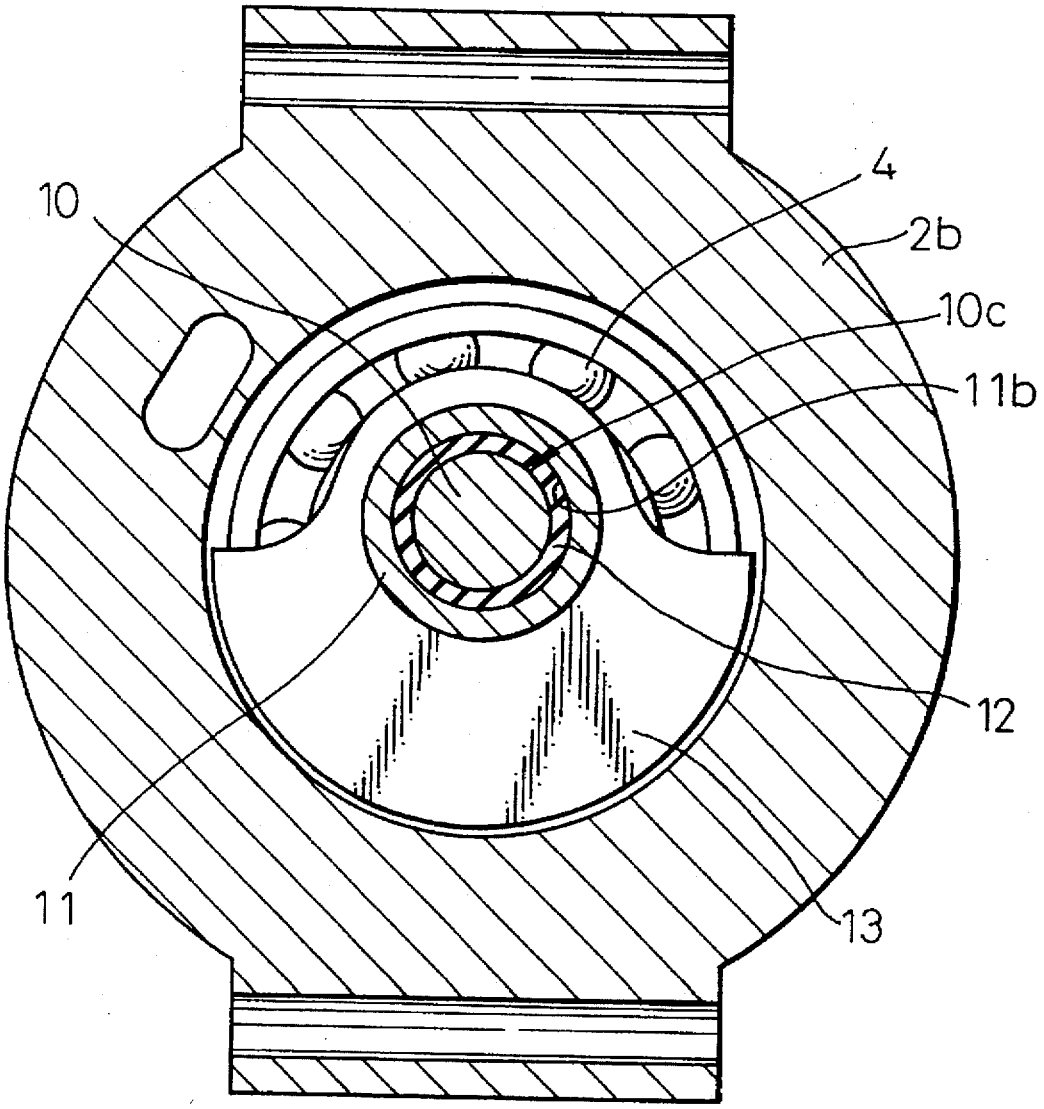
FIG. 2 is a lateral cross-sectional side view taken along a line II—II in FIG. 1.

FIG. 1 shows the overall configuration of a scroll type compressor 1 according to an embodiment of the present invention. The configuration of the partial lateral cross-section is shown in FIG. 2. This scroll type compressor 1 has a similar configuration to that of the conventional one in most parts. Namely, a housing 2 comprises three parts integrally fastened with each other by means such as bolts, that is, a center housing 2*a*, a front housing 2*b*, and a rear housing 2*c*. A fixed scroll member 3 is formed in an internal portion of the center housing 2 integrally with this, and a drive shaft 5 supported by a bearing 4 is extended in the front housing 2*b* so as to penetrate through this.

The drive shaft 5 rotatably supported by the bearing 4 introduces a rotation force propagated from a prime mover such as a not illustrated internal combustion engine (a hydraulic motor or electric motor is also possible) into the scroll type compressor 1. On the axial end of an enlarged diameter portion 5*a* of the drive shaft, the driven crank mechanism 6 provided with the characteristic of the present invention is formed. The configuration thereof will be explained in detail later. A movable scroll member 7 is connected to the driven crank mechanism 6. On back of the movable scroll member 7, there are provided a thrust supporting and rotation preventing mechanism 8 which allows only the orbiting of the movable scroll member 7 and prevents the rotation of the movable scroll member 7 at the driving and, at the same time, supports the thrust in the axial direction acting upon the movable scroll member.

The fixed scroll member 3 and the movable scroll member 7 are provided with spiral-shaped vanes 3*a* and 7*a* having substantially the same shape and have the same length (width) in the axial direction. They are supported in combination in a manner so that they are engaged with each other shifted in phase by 180 degrees in the rotation direction relative to each other and in an eccentric state, whereby two or more fluid compression pockets P of crescent shapes when viewed in the axial direction are formed between those vanes for compressing the fluid.

In the case of the embodiment shown in FIG. 1, the movable scroll member 7 comprises a spiral-shaped vane 7*a* and a disk-like side plate 7*b* which is integrally attached to the same. A boss portion 7*c* having a large diameter and a hollow cylindrical shape and projecting leftward in the axial direction is formed as an integral body at the center of the back of the side plate 7*b*. The boss portion 7*c* is rotatably connected via a needle bearing 9 and a driven crank mechanism 6, a detailed configuration of which is shown in FIG. 3 to FIG. 6, to the drive shaft 5 and is supported by this.

The driven crank mechanism 6 mainly comprise a drive key 10 which is integrally formed so as to project from the eccentric position on one end surface of the diameter enlarged portion 5*a* of the drive shaft 5 in the axial direction; a short column-shaped bush 11 which supports the boss portion 7*c* of the movable scroll member 7 so that it can rotate; and an elastic body 12 such as an annular rubber inserted between the drive key 10 and the bush 11 as the characteristic feature of the present invention. Note that, a balance weight 13 for canceling at least a part of the centrifugal force acting upon the movable scroll member 7 orbiting eccentric with respect to the drive shaft 5 is integrally attached to the bush 11. Also, 15 shown in FIG. 3 etc. is a snap ring for stopping the detachment of the bush 11 and fitted with a groove 10*d* formed in the end portion of the drive key 10. Reference numeral 15*a* is a washer used for auxiliary use.

Although it has no direct relationship with respect to the characteristic feature of the present invention, as a part of the fundamental configuration of the scroll type compressor, a thrust supporting and rotation preventing mechanism 8 in the embodiment shown in FIG. 1 comprises: a plurality of rotation hindering pins 8*a* attached to an inner surface of the front housing 2*b* in the axial direction; a plurality of rotation hindering pins 8*b* attached to the back surface of the side plate 7*b* of the movable scroll member 7 in the axial direction so as to be engaged with this; a ring 8*c* having a circular hole into which a pair of rotation hindering pins 8*a* and 8*b* are loosely inserted; schematically an annular smooth plate 14 excellent in the abrasion resistance inserted as a spacer to between the inner surface of the front housing 2*b* and the back surface of the side plate 7*b* of the movable scroll member 7, etc. It is also possible even if a hard metal plating is applied to the back surface of the side plate 7*b* of the movable scroll member which comes into sliding contact with the front surface of the plate 14 so as to impart the abrasion resistance to this.

Also, in the scroll type compressor 1 of the illustrated embodiment, as shown in FIG. 1, an exhaust port 3*c* is opened at the center of the side plate 3*b* of the fixed scroll member 3 and an exhaust valve 16 made of a thin metal piece having resiliency is attached to the side plate 3*b* in a cantilever manner so as to close the exhaust port 3*c* from the outside. Reference numeral 17 is a valve stopper preventing excessive opening of the exhaust valve 16. Note that, in FIG. 1, 18 is a shaft sealing device which seals the drive shaft 5 and the shaft opening port of the front housing 2*b*; 19 is an O-ring sealing the front housing 2*b* and the center housing 2*a*; and 20 is a bolt fastening the center housing 2*a* and the rear housing 2*c*. Needless to say a space 2*e* in the rear housing 2*c* acts as a high pressure chamber into which the compressed fluid is exhausted, that is, an exhaust chamber.

In the illustrated embodiment, the drive key 10 formed at the shaft end of the drive shaft 5 is also referred to as a two-surface width portion. By grinding a short columnar shaft projecting from the eccentric position of the enlarged diameter portion 5*a* to the axial direction, two planes 10*a* and 10*b* parallel to the radial direction are formed. The drive key 10 is engaged with the bush 11 so that it can slide with respect to the groove 11*a* formed in the radial direction or in parallel to the radial direction. The length of the groove 11*a* in the radial direction or the direction parallel to the radial direction becomes longer than that of the drive key 10 by exactly a predetermined value.

When the driven crank mechanism 6 in the illustrated embodiment is assembled, the inner surface of the annular elastic body 12, corresponding to the characteristic feature of the present invention, is fitted over the outside of the columnar portion 10*c* of the base portion of the drive key 10. At the same time, the outer surface of the elastic body 12 is in contact with the inner surface of the annular step portion 11*b* formed at the base portion of the groove 11*a* of the bush 11 (part on left side in FIG. 1 and FIG. 3). Due to this, the bush 11 having the groove 11*a* can move relatively in the radial direction with respect to the drive key 10 by deformation of at least one part of the annular elastic body 12 under compression. At this time, the elastic body 12 generates a centripetal force preventing relative sliding between the drive key 10 and the bush 11.

Since the scroll type compressor 1 of the illustrated embodiment is constituted in this way, when the drive shaft 5 is driven to rotate by an outside prime mover, as a basic operation of the scroll type compressor, similar to that of the conventional compressor, the bush 11 constituting a part of the driven crank mechanism 6 is rotated while being eccentric with respect to the drive shaft 5, therefore also the movable scroll member 7 engaged via the needle bearing 9 in the boss portion 7*c* intends to rotate similarly, but since the thrust supporting and rotation preventing mechanism 8 is provided, the rotation of the movable scroll member 7 is hindered and it will only engage in orbital motion with the amount of eccentricity at that time as the radius.

Due to this, a crescent fluid compression pocket P formed between the spiral-shaped vane 3*a* of the fixed scroll member 3 and the spiral-shaped vane 7*a* of the movable scroll member 7 takes in the fluid such as the refrigerant while opening in the intake space 2*f* at the outer circumferences of the scroll members 3 and 7, the fluid compression pocket P is closed along with the orbital motion of the movable scroll member 7, and its 5 volume is reduced during a period where the fluid compression pocket P gradually moves toward the center. Accordingly, the fluid in the fluid compression pocket P is compressed. When the fluid compression pocket P becomes open at the center of the fixed scroll member 3, the refrigerant is exhausted into a space 2*e*, that is, the exhaust chamber, by pushing and opening the exhaust valve 16 from the exhaust port 3*c*.

In the case of the illustrated embodiment, an elastic body 12 such as annular rubber is interposed between the drive key 10 of the driven crank mechanism 6 and the bush 11, therefore when the scroll type compressor 1 stops, there will no longer be a portion which is strongly compressed while being partially eccentric at the periphery of the elastic body 12, in other words, a partial compression stress acting upon the elastic body 12 will be balanced at the periphery of the drive key 10. Due to this, the bush 11 centripetally slides toward the center of the drive key 10 in the radial direction up to the balanced position. As a result, the fixed scroll member 7 comes to have a predetermined initial eccentricity with respect to the drive shaft 5. Accordingly, by setting things up so that a slight gap is produced at a contact portion of the spiral-shaped vane 7*a* of the movable scroll member 7 with respect to the spiral-shaped vane 3*a* of the fixed scroll member 3 which is the sealed portion, the next restart can be smoothly carried out without a shock.

By imparting a predetermined inclination to the direction of the plane 10*a* of the drive key 10 and the groove 11*a* of the bush 11 with respect to the plane connecting the axial line of the drive shaft 5 and the center line of the bush 11, the anti-compression force due to the compression of the fluid in the fluid compression pocket P acts upon a space between the plane 10*a* or 10*b* of the drive key 10 and the plane of the groove 11*a* of the bush 11 in sliding contact with this, thereby to generate a force in the radial direction that increases the amount of eccentricity of the bush 11 and the movable scroll member 7 as the partial force thereof. This force increases the amount of eccentricity of the bush 11 together with the remaining centrifugal force not canceled by the balance weight 13 in the centrifugal force acting upon the movable scroll member 7 and generates a force pushing the movable scroll member 7 against the fixed scroll member 3 and closes the sealed portion of the fluid compression pocket P in the contact portion of the two spiral-shaped vanes 3*a* and 7*a*.

If the contact in the contact portion of the two spiral-shaped vanes 3*a* and 7*a* due to an increase of the amount of eccentricity of the bush 11 and the movable scroll member 7 occurs with an impact, noise must be generated for the above reasons, but in the embodiment according to the present invention, the annular elastic body 12 is interposed between the drive key 10 and the bush 11, and therefore when the vanes contact, first a part of the elastic body 12 will be compressed in the radial direction between the column-like portion 10*c* of the base portion of the drive key 10 and the annular step portion 11*b* of the bush 11, whereby the shock of contact is buffered and the generation of noise is prevented. The part of the annular elastic body 12 compressed at this time will be referred to as a compression region 12*a*.

In the case of the illustrated embodiment according to the present invention, the function of preventing noise is produced not only at the time of the startup of the scroll type compressor 1, but also at the shutdown. Namely, due to the disappearance of the anti-compression force in the fluid compression pocket P at the time of shutdown, the bush 11 moves in the radial direction with respect to the drive key 10 so as to reduce the amount of eccentricity of the bush 11 and the movable scroll member 7 with respect to the drive shaft 5. Then, during the operation, the inner surface of one end portion of the groove 11*a* of the bush 11 and the end portion in the radial direction of the drive key 10 facing this, which were separated from each other during the operation, strike each other, whereby a shock is propagated to the spiral-shaped vane 7*a* of the movable scroll member 7 through the boss portion 7*c* and noise will be generated. Alternatively, if the amount of eccentricity is abruptly reduced as mentioned before, the rotation restraint force of the rotation preventing mechanism 8 is weakened, and therefore the movable scroll member 7 rotates by exactly a slight angle, the spiral-shaped vane 7*a* again strikes the spiral-shaped vane 3*a* of the fixed scroll member 3, and this also becomes a cause of generation of noise, but in the illustrated embodiment, in the annular elastic body 12, a part on the opposite side to that of the case of startup is compressed in the radial direction between the column-like portion 10*c* of the base portion of the drive key 10 and the annular step portion 11*b* of the bush 11, whereby the shock is buffered and therefore the generation of noise is prevented also in this case. The part of the annular elastic body 12 compressed at this time will be referred to as a compression region 12*b*.

As apparent from the above explanation, in the annular elastic body 12 in the illustrated embodiment, two parts located at opposite positions in the radial direction at the time of the startup and at the time of the shutdown of the scroll type compressor 1, that is, the compression regions 12*a* and 12*b*, are compressed between the column-like portion 10*c* of the base portion of the drive key 10 and the annular step portion 11*b* of the bush 11 and serve to buffer shock due to the collision between the front and rear end portions of the drive key 10 and the end portions of the inner surface of the groove 11*a* of the bush 11 facing the same or collision between the spiral-shaped vanes 3*a* and 7*a* of the two scroll members 3 and 7 and the other parts other than the two compression regions 12*a* and 12*b* serve to connect these two compression regions to form one series of elastic bodies 12. Accordingly, basically, it is possible to constitute the two compression regions 12*a* and 12*b* by two independent elastic bodies not connected to each other. Note that, where the two compression regions are constituted by two elastic bodies independent from each other, even if these elastic bodies are not provided at a position of the elastic body 12 of the illustrated embodiment, it is also possible to attach the same to the two end portions in the radial direction of the drive key 10 in for example the groove 11*a* of the bush 11.

In general, however, integral formation of the two compression regions by a single elastic body is more advantageous than configuring them by two mutually independent elastic bodies in various points, for example, the number of parts can be decreased by this, the assembly and installation become easy, also the retention of the position of the elastic body after assembly and installation becomes reliable, etc. Therefore, an explanation will be made of a preferred embodiment of the shape of the elastic body where the two compression regions 12*a* and 12*b* are constituted by a single elastic body by using FIG. 4 to FIG. 6.

Figure 4:
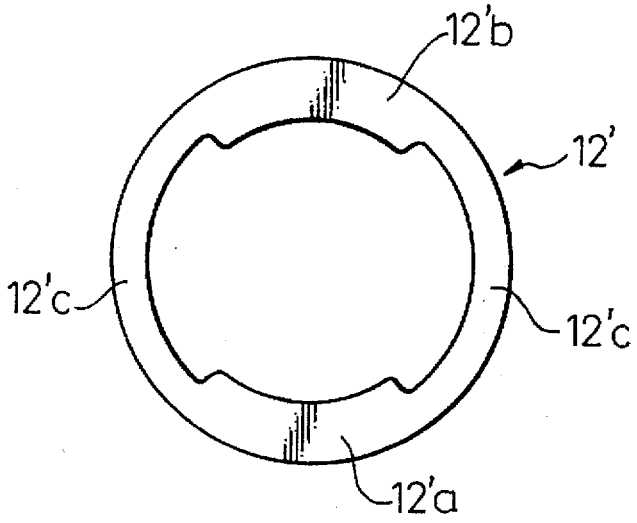
FIG. 4 is a front view showing a concrete example of an elastic body.

The annular elastic body 12' shown in FIG. 4 is obtained in place of the elastic body 12 in the embodiment mentioned before, and the whole is made of a material having resiliency such as rubber and has a shape that projects inwardly in the portion of the two compression regions 12'*a* and 12'*b*. Accordingly, although the cross-sectional shape is not uniform at the circumference, there is an advantage that the two compression regions 12'*a* and 12'*b* of the elastic body and a connecting portion 12'*c* other than them can be given cross-sectional shapes suited to different purposes. Since the two compression regions 12'*a* and 12'*b* are connected by two connecting portions 12'*c* and constitute an integral annular body, they provide also the advantage of the single elastic body as mentioned before.

Figure 3:
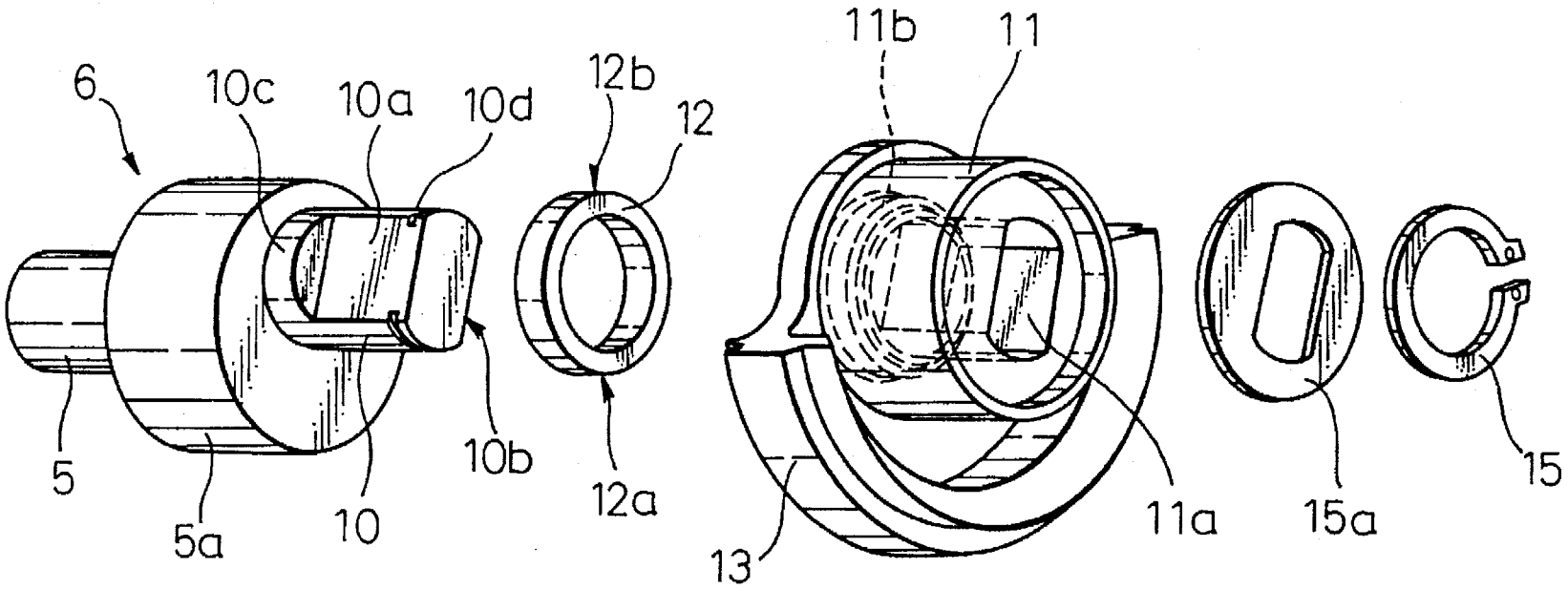
FIG. 3 is a disassembled perspective view showing principal parts of the embodiment while enlarged.
Figure 5:
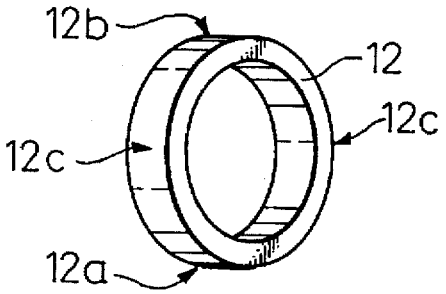
FIG. 5 is a perspective view showing another concrete example of the elastic body.
Figure 6:
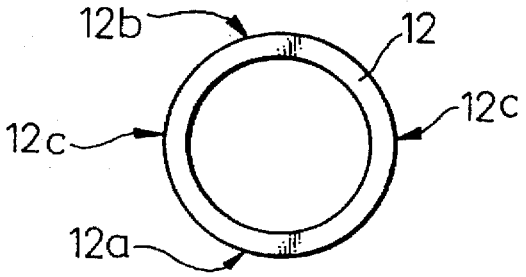
FIG. 6 is a front view of the elastic body shown in FIG. 5.

FIG. 5 and FIG. 6 show only the annular elastic body 12 in the embodiment shown in FIG. 3 etc. FIG. 5 is a perspective view of the elastic body 12, and FIG. 6 is similarly a front view. As apparent from the explanation for the illustrated embodiment, the annular elastic body 12 is differentiated into the portions serving as the two compression regions 12*a* and 12*b* and the portion serving as the connecting portion 12*c* connecting them by the position in the rotation direction where it is installed, but is not differentiated into these regions before assembly and installation since it is an annular body having a uniform cross-sectional shape.

The elastic body 12 can be produced easily and at a low cost as a simple annular body made of a material such as rubber and having a constant cross-sectional shape in the circumferential direction. Moreover, also at the assembly and installation, it is not necessary to perform the positioning in the rotation direction, and therefore the assembly and installation become further easier than the case of the elastic body 12' shown in FIG. 4. The elastic body 12 exhibits also an effect of retention of position in the axial direction after the assembly and installation, but there is a possibility that the position will shift in the rotation direction. However, there is no problem due to this, and therefore it may be rather more advantageous in that local fatigue of the material does not occur. Note, it is not as good as the elastic body 12' in the point of setting the cross-sectional shape to the best state for the two compression regions 12*a* and 12*b* and the connecting portion 12*c*.

Figure 7:
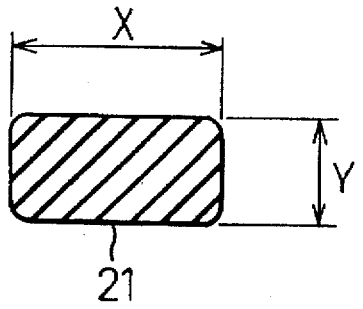
FIG. 7 is a cross-sectional view illustrating a cross-sectional shape of the elastic body.

As a preferred embodiment for the cross-sectional shape of the elastic body which can be used as a general elastic body 21, that is, the integral elastic bodies 12 and 12' or two mutually independent elastic bodies constituting the two compression regions 12*a* and 12*b*, for example, as shown in FIG. 7, a shape which is a rectangle in which the length X in the axial direction has a larger dimension than the thickness Y of the radial direction (compression direction) and in addition which has roundish corners at the four corners can be mentioned. By setting the cross-sectional shape of the elastic body 12 in this way, it becomes possible to generate a sufficiently large repulsion force when the elastic body 21 is compressed while making the size of the scroll type compressor 1 in the radial direction relatively small. Also, since the corners R are formed at the four corners, the assembly and installation become easy.

Figure 8:
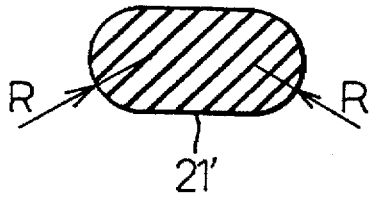
FIG. 8 is a cross-sectional view illustrating a cross-sectional shape of another elastic body.

FIG. 8 shows another preferred example of the cross-sectional shape for a general elastic body 21' as well. In this case, the effect produced by the vertical and lateral dimensional proportions is substantially the same as in the example shown in FIG. 7. Further, the two end surfaces in the axial direction are given roundish corners, therefore the assembly and installation of the elastic body 21' become further easier than that in the example of FIG. 7.

Figure 9:
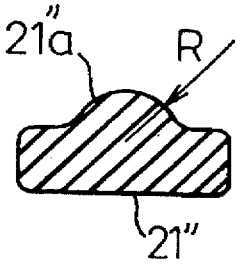
FIG. 9 is a cross-sectional illustrating the cross-sectional shape of still another elastic body.
Figure 10:
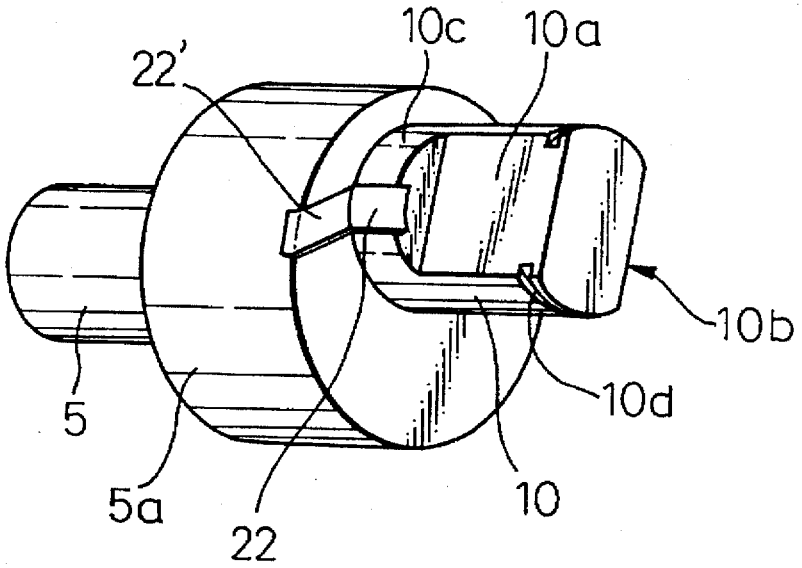
FIG. 10 is a perspective view showing an example of establishment of a lubricant oil groove in the driven crank mechanism.
Figure 11:
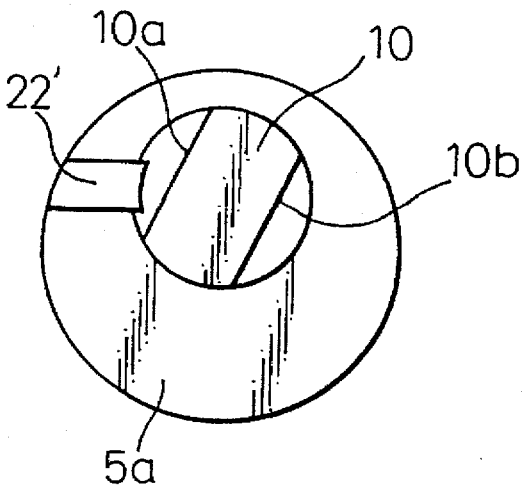
FIG. 11 is a side view of a part of a driven crank mechanism shown in FIG. 10.

FIG. 9 shows a preferred cross-sectional shape for still another general elastic body 21". In this example, a projection 21"*a* is formed on one surface in the radial direction of the elastic body 21". The useful function of the projection 21"*a* is that the abutting posture of the projection 21"*a* against the plane of the opposite side against which it abuts, that is, the plane of for example the column-like portion 10*c* of the base portion of the drive key 10 or the annular step portion 11*b* of the bush 11 explained in relation to the illustrated embodiment, becomes uniform and variations of the repulsion force characteristics of individual scroll type compressors 1 can be suppressed.

Where a configuration is adopted in which the elastic body for generating the repulsion force such as the elastic body 12 or 12' is in close contact with a smooth portion such as the column-like portion 10*c* of the base portion of the drive key 10 and the annular step portion 11*b* of the inner surface of the bush 11 which were explained in the embodiment, lubricant oil such as the refrigerator oil can no longer flow along the surface thereof, and therefore there is a possibility that the lubrication of the sliding parts of the driven crank mechanism 6 etc. will become insufficient. One of countermeasures to this problem is shown in FIG. 10 and FIG. 11. Namely, in this example, a lubricant oil groove 22 is formed in the axial direction in the surface in question. This groove is not closed by the general elastic body 21 etc.

Further, where one part of the side surface of the enlarged diameter portion 5*a* of the drive shaft 5 is covered by the general elastic body 21 or the like and the lubricant oil can no longer flow into the lubricant oil groove 22, an extended lubricant oil groove 22' is formed in also the side surface of the enlarged diameter portion 5*a* to facilitate the flow of the lubricant oil into the lubricant oil groove 22. Similarly, needless to say a groove like the lubricant oil groove 22 is formed in the annular step portion 11*b* of the inner surface of the bush 11, but it is not always necessary to form the lubricant oil groove on this side.

In the embodiment shown in FIG. 10 and FIG. 11, by-pass passages for the lubricant oil such as the lubricant oil grooves 22 and 22' are formed in the surfaces in which the flow of the lubricant oil is blocked by the general elastic bodies 21, 21', and 21", but in contrast there arises a concern over possible abnormal abrasion of the elastic body 21 or the like at the portion where it comes into contact with the edge portion of the lubricant oil groove 22 or 22' and in the worst case possible breakage. Therefore, so as to eliminate such a concern, an embodiment in which, instead of forming the lubricant oil grooves 22 and 22', a lubricant oil hole 23 is made in the inside from the drive key 10 to the enlarged diameter portion 5*a* of the drive shaft 5 is shown in FIG. 12.

Figure 12:
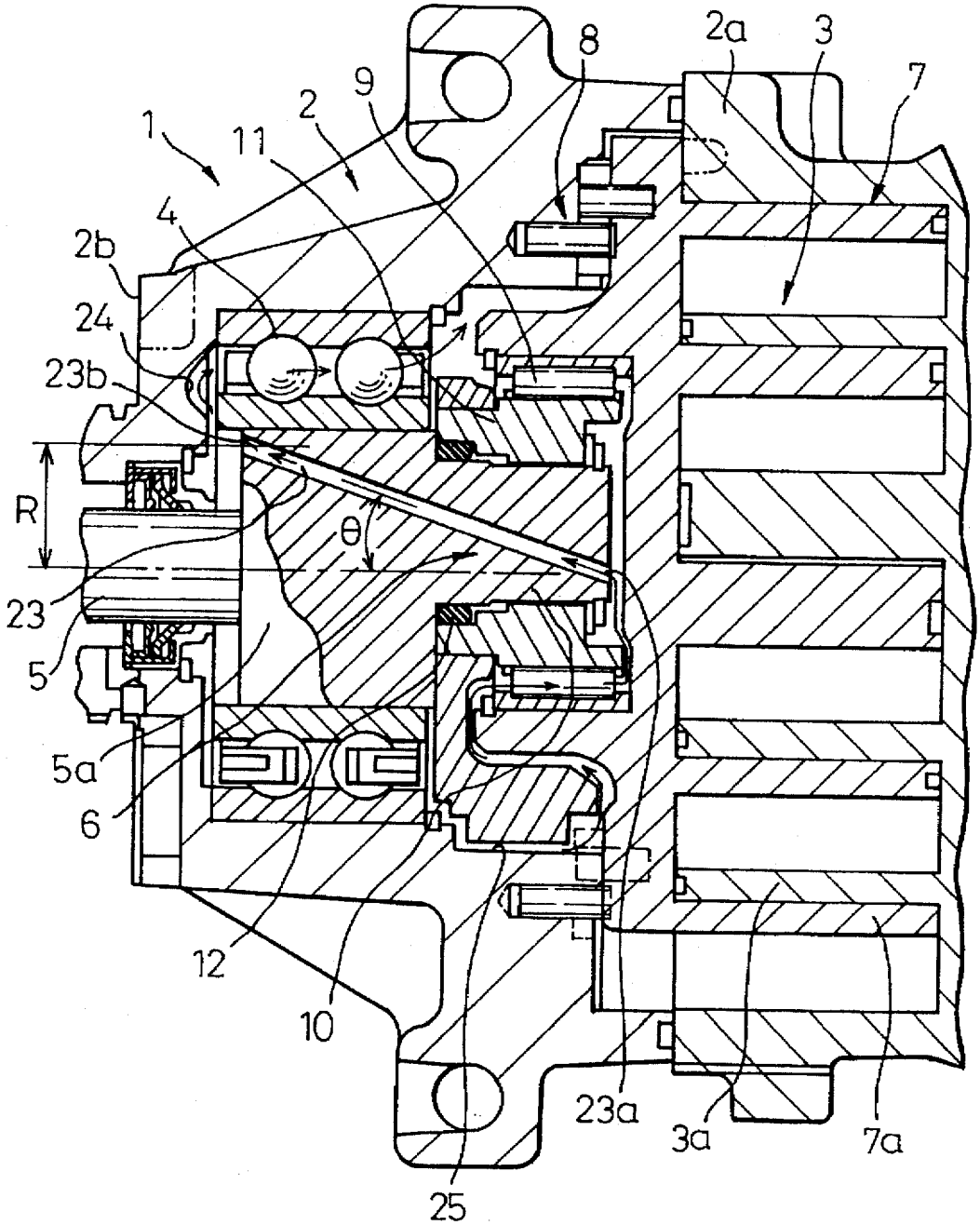
FIG. 12 is a longitudinal cross-sectional front view showing a partial structure of the scroll type compressor provided with a lubricant oil hole in the driven crank mechanism.

Most of the configuration of the embodiment shown in FIG. 12 is the same as that shown in the previously explained FIG. 1 etc., but in this example, the lubricant oil grooves 22 and 22' are not formed, but the lubricant oil hole 23 is obliquely formed so as to connect the position 23*a* near the center axis of the drive shaft 5 in the end surface of the drive key 10 and the position 23*b* of the radius R of the outside end surface of the enlarged diameter portion 5*a* of the drive shaft. Note that, in the embodiment of FIG. 12, a guide surface 24 comprising a smooth hollow is formed in the inner surface of the front housing 2*b* corresponding to the position 23*b* of the lubricant oil hole 23, thereby to make the flow of the lubricant oil smooth.

When defining the angle of inclination of the lubricant oil hole 23 with respect to the center axis line of the drive shaft 5 as $\theta$ and assuming that the drive shaft 5 rotates at an angular speed of $\omega$, the value of the centrifugal force acting upon the lubricant oil existing in the lubricant oil hole 23 is $mR\omega^2$ near the position 23*b* of the lubricant oil hole 23 and 0 near the position 23*a* where the mass of the unit volume of the mixture of the lubricant oil and the fluid to be compressed (refrigerant) passing in the lubricant oil hole 23 is m. Therefore the lubricant oil collected in the lower portion of the crank chamber 25 is sucked from the position 23*a* of the lubricant oil hole 23, and the flow of the lubricant oil to be sent from the position 23*a* toward the position 23*b* by the centrifugal force is generated by the rotation of the drive shaft 5. As a result, even if there is something blocking the path of flow of the lubricant oil such as the annular elastic body 12, as indicated by an arrow in FIG. 12, the lubricant oil is forcibly circulated, and therefore the main elements of the bearing 4, thrust supporting and rotation preventing mechanism 8, needle bearing 9, etc. are sufficiently lubricated, the lowering of the 10 durability due to the abrasion can be prevented, and thus the reliability is improved.

In the above embodiment, there is adopted a configuration wherein the groove 11*a* is formed in the bush 11 which can be rotated by the needle bearing 9 in the internal portion of the boss portion 7*c* formed at the side plate 7*b* of the movable scroll member 7, and a drive key 10 formed integrally so as to project from the enlarged diameter portion 5*a* of the drive shaft 5 in the axial direction is engaged with this, but substantially the same mode of operation and effect can be exhibited even if the drive and driven relationship of the drive key 10 and the groove 11*a* become reverse. Namely, clearly it is also possible even if a groove such as the groove 11*a* is formed in the enlarged diameter portion 5*a* of the drive shaft 5 and, at the same time, a key in the axial direction such as the drive key 10 is formed on the bush 11 side as one which is engaged with this groove and driven.

We claim:

1. A scroll type compressor comprising:

a rotationally driven drive shaft having a center-line axis of rotation;

a fixed scroll member which has a spiral-shaped vane and is supported in a fixed manner;

a movable scroll member which has a spiral-shaped vane engaging with said spiral-shaped vane of said fixed scroll member to form fluid compression pockets therebetween, wherein said movable scroll member is supported in an eccentric state and driven by said drive shaft, so that said movable scroll member orbits said drive shaft and compresses a fluid in said fluid compression pockets;

a bush which rotatably supports said movable scroll member on said drive shaft, said bush having a center-line axis of rotation that is offset from said center-line of said drive shaft;

a rotation preventing mechanism constructed and arranged to allow only orbital motion of said movable scroll member and to hinder rotation of said movable scroll member;

a driven crank mechanism interposed between said drive shaft and said movable scroll member and constructed and arranged to transfer torque from said drive shaft to said movable scroll member and to support said movable scroll member, wherein said driven crank mechanism is provided with a drive projection having at least one flat plane projecting in an axial direction and said bush is provided with a groove for receiving said drive projection, said drive projection being slidable within said groove and said groove having a longer length in the radial direction than that of said drive projection so that an amount of eccentricity of said movable scroll member with respect to said drive shaft is variable, and wherein said flat plane of said drive projection and said groove of said bush are inclined with respect to a straight line connecting the center-line of said drive shaft and the center-line of said bush in a direction opposite to a direction of rotation of said drive shaft so that the amount of eccentricity of said movable scroll member increases with increased pressure in said fluid compression pockets to force the spiral-shaped vane of said movable scroll member against the spiral-shaped vane of said fixed scroll member in the radial direction and the amount of eccentricity of said movable scroll member decreases with decreased pressure in said fluid compression pockets to allow the spiral-shaped vane of said movable scroll member to move away from the spiral-shaped vane of said fixed scroll member in the radial direction; and at least one elastic body having two compression regions disposed between said drive projection and said groove, wherein one of said two compression regions is compressed at compressor startup when said movable scroll member is forced toward the fixed scroll member in the radial direction by increased pressure in the fluid compression pockets, and the other of said two compression regions is compressed at compressor shutdown when the amount of eccentricity of said movable scroll member decreases due to decreased pressure in the fluid compression pockets, whereby startup and shutdown shocks are buffered.

2. A scroll type compressor as set forth in claim 1, wherein said drive projection and said bush are constructed and arranged so that during a normal operation condition between start-up and shutdown, repulsion forces between said drive projection and said bush generated in said two compression regions are mutually balanced and thereby substantially canceled.

3. A scroll type compressor as set forth in claim 1, wherein elastic bodies forming said two compression regions are made integral by connection with each other.

4. A scroll type compressor as set forth in claim 3, wherein said two compression regions are integrally constituted by single annular elastic body which is formed with a substantially uniform cross-sectional shape.

5. A scroll type compressor as set forth in claim 1, wherein in the cross-sectional shape of said elastic body, the length in the axial direction is set larger than the thickness in the radial direction.

6. A scroll type compressor as set forth in claim 1, wherein in the cross-sectional shape of said elastic body, at least one end surface in the axial direction is given a roundish corner.

7. A scroll type compressor as set forth in claim 1, wherein in the cross-sectional shape of said elastic body, at least one surface in the radial direction is provided with a projection.

8. A scroll type compressor as set forth in claim 7, wherein a portion in a surface of a drive projection side or bush side against which the projection of said elastic body abuts is formed as a cylindrical surface.

9. A scroll type compressor as set forth in claim 7, wherein a lubricant oil groove by-passing said elastic body is formed in a portion of a surface of a drive projection side or bush side against which the projection of said elastic body abuts.

10. A scroll type compressor as set forth in claim 1, wherein a lubricant oil hole is obliquely formed from an end surface of the drive projection to an end surface of an enlarged diameter portion of the drive shaft.

11. A scroll type compressor as set forth in claim 1, wherein, said drive projection and said bush are constructed and arranged so that repulsion forces between said drive projection and said bush respectively generated in said two compression regions of said at least one elastic body forming these compression regions are balanced and canceled by each other, whereby the orbital radius of said bush and said movable scroll member in a shutdown state becomes smaller than that in an operative state.

12. A scroll type compressor as set forth in claim 1, wherein said drive projection comprises a drive key having a column-like portion formed at the base thereof which is formed so as to project in the axial direction from an eccentric position in an end portion of said drive shaft said groove of said bush has an annular step portion formed in the base thereof; said at least one elastic body is inserted between said drive key and said bush; and said elastic body is installed between the column-like portion formed on the base portion of said drive key and the annular step portion formed on the base portion of said groove of said bush.

13. A scroll type compressor as set forth in claim 12, wherein a groove is formed in an end portion of said drive key for receiving a snap ring for stopping removal of said bush and wherein a washer is placed over said drive key between said bush and said snap ring.

14. A scroll type compressor as set forth in claim 12, wherein a balance weight for canceling at least one part of the centrifugal force acting upon said movable scroll member orbiting while being eccentric with respect to said drive shaft is integrally attached to said bush.

15. A scroll type compressor comprising:

a drive shaft having an axis of rotation;

a fixed scroll member having a spiral vane;

a movable scroll member having a spiral vane engaging with said spiral vane of said fixed scroll member to define fluid compression pockets;

a bush rotatably supporting said movable scroll member on said drive shaft in a position eccentric with respect to said axis of rotation of said drive shaft, said bush having an axis of rotation offset from said axis of rotation of said drive shaft, said bush further having a centrally-located groove formed therein;

a drive projection extending axially from an eccentric position at an end of said drive shaft into said groove of said bush, said drive projection having a flattened surface and said groove having a mating flattened portion, said drive projection being slidable within said groove and said groove having a length that is longer than a width of said groove so that an eccentricity of said movable scroll member with respect to said drive shaft is variable; and an elastic body having diametrically opposed compression regions disposed between said drive projection and said groove, wherein said flattened surface of said drive projection and said flattened portion of said groove are inclined in a direction opposite a direction of rotation of said drive shaft with respect to a line connecting said axis of rotation of said drive shaft with said axis of rotation of said bush so that the eccentricity of said movable scroll member increases and decreases with increased and decreased pressure, respectively, in said fluid compression pockets, and wherein one of said compression regions is compressed at compressor start-up when the eccentricity of said movable scroll member increase due to increased pressure in said compression pockets to absorb impact and reduce noise due to sudden increases in the eccentricity of said movable scroll member, and the other of said compression regions is compressed at compressor shut-down when the eccentricity of said movable scroll member decreases due to decreased pressure in said compression pockets to absorb impact and reduce noise due to sudden decreases in the eccentricity of said movable scroll member.

16. A scroll type compressor comprising:

a rotationally driven drive shaft having a center-line axis of rotation;

a fixed scroll member which has a spiral-shaped vane and is supported in a fixed manner;

a movable scroll member which has a spiral-shaped vane engaging with said spiral-shaped vane of said fixed scroll member to form fluid compression pockets therebetween, wherein said movable scroll member is supported in an eccentric state and driven by said drive shaft to thereby orbit said drive shaft and compress a fluid in said fluid compression pockets;

a bush which rotatably supports said movable scroll member on said drive shaft, said bush having a center-line axis of rotation that is offset from said center-line of said drive shaft;

a rotation preventing mechanism constructed and arranged to allow only orbital motion of said movable scroll member and to hinder rotation of said movable scroll member;

a driven crank mechanism interposed between said drive shaft and said movable scroll member and constructed and arranged to transfer torque from said drive shaft to said movable scroll member and to support said movable scroll member, wherein said driven crank mechanism is provided with a drive key extending axially from an eccentric position in an end of said drive shaft and said bush is provided with a groove for receiving said drive key, said drive key having at least one flat plane projecting in an axial direction, said drive key being slidable within said groove and said groove having a longer length in the radial direction than that of said drive key so that an amount of eccentricity of said movable scroll member with respect to said drive shaft is variable, said-drive key having a column-like portion formed in the base thereof and said groove having an annular step portion formed in the base thereof, and wherein said flat plane of said drive key and said groove of said bush are inclined in a direction opposite to a direction of rotation of said drive shaft with respect to a straight line connecting the center-line of said drive shaft and the center-line of said bush so that the amount of eccentricity of said movable scroll member increases with increased pressure in said fluid compression pockets to force the spiral-shaped vane of said movable scroll member against the spiral-shaped vane of said fixed scroll member in the radial direction and the amount of eccentricity of said movable scroll member decreases with decreased pressure in said fluid compression pockets to allow the spiral-shaped vane of said movable scroll member to move away from the spiral-shaped vane of said fixed scroll member in the radial direction; and at least one elastic body having two compression regions disposed between said column-like portion formed in the base portion of said drive key and the annular step portion formed in the base portion of said groove of said bush.

17. A scroll type compressor as set forth in claim 16, wherein a groove is formed in an end portion of said drive key for receiving a snap ring for stopping removal of said bush and wherein a washer is placed over said drive key between said bush and said snap ring.

18. A scroll type compressor as set forth in claim 16, wherein a balance weight for canceling at least one part of the centrifugal force acting upon said movable scroll member orbiting while being eccentric with respect to said drive shaft is integrally attached to said bush.

* * * * *

UNITED STATES PATENT AND TRADEMARK OFFICE

CERTIFICATE OF CORRECTION

| | | |
|---|---|---|
| PATENT NO. | : | 5,681,155 |
| DATED | : | October 28, 1997 |
| INVENTOR(S) | : | Shigeru HISANAGA; Tsuyoshi TAKEMOTO; Shigeki IWANAMI; Haruhisa SHIBATA; Takeshi SAKAI; Masafumi NAASHIMA; Mikio MATSUDA; Tetsuhiko FUKANUMA; Tetsuo YOSHIDA; Yasushi WATANABE; Shinsuke Asou |

It is certified that error appears in the above-identified patent and that said Letters Patent is hereby corrected as shown below:

On the face of the patent, please correct the spelling of the following two inventors:

[75] Inventors: "Tatsuhiko Fukanuma" to --Tetsuhiko Fukanuma--; and

"Shinsuke Aso" to --Shinsuke Asou--.

Signed and Sealed this

Twentieth Day of April, 1999

*Attest:*

Q. TODD DICKINSON

*Attesting Officer*

*Acting Commissioner of Patents and Trademarks*